United States Patent [19]

Savaria

[11] Patent Number: 4,534,450

[45] Date of Patent: Aug. 13, 1985

[54] INVALID LIFT

[76] Inventor: Pierre Savaria, 199 St. Joseph St., Oka, Canada, J0N 1E0

[21] Appl. No.: 605,222

[22] Filed: Apr. 30, 1984

[51] Int. Cl.[3] ..... B66B 9/20

[52] U.S. Cl. ..... 187/9 R; 414/921

[58] Field of Search ..... 187/9 R, 62; 414/921, 414/546, 556; 182/223; 49/33, 131, 133, 366

[56] References Cited

U.S. PATENT DOCUMENTS

| | | | |
|---|---|---|---|
| 489,755 | 1/1893 | Prevear | 187/62 |
| 3,651,965 | 3/1972 | Simonelli et al. . | |
| 3,710,962 | 1/1973 | Fowler, Jr. . | |
| 3,910,432 | 10/1975 | Browne et al. . | |
| 3,918,596 | 11/1975 | Ward . | |
| 3,957,164 | 5/1976 | Brown . | |
| 3,984,914 | 10/1976 | Pohl . | |
| 4,022,337 | 5/1977 | Eichenhofer et al. . | |
| 4,140,230 | 2/1979 | Pearson | 414/921 |
| 4,252,491 | 2/1981 | Hock | 414/921 |
| 4,273,217 | 6/1981 | Kajita | 187/9 R |

FOREIGN PATENT DOCUMENTS

| | | |
|---|---|---|
| 930335 | 7/1973 | Canada . |
| 1090743 | 2/1980 | Canada . |
| 1085784 | 9/1980 | Canada . |

*Primary Examiner*—Joseph J. Rolla
*Assistant Examiner*—Andrew Jones

[57] ABSTRACT

An invalid lift assembly installed in a vehicle such as a van or the like. It is specially adapted to permit a non-invalid person to use the door opening even when it is stored. The lift assembly comprises a platform which is made of a frame supporting two independent sections displaceable in between a coplanar position and a transverse position. The platform is rotatable in between an upstanding stored position inside the vehicle and an outside intermediate position level and parallel with the vehicle floor and moveable from that position to the ground and inversely. A pair of armatures swingable in parallel paths on each side of the platform connect the platform to the vehicle.

7 Claims, 10 Drawing Figures

14
17
19
40'
40
A
18
28
27
29
38
37
12
11
32
16
C
7
36
33
39
3
20
6
25
26
41
13
50
49
4
10
39
39'

14
15
40
12
11
38

24
24
2
8
33
37
7
56
3
9
10
46
6
46

INVALID LIFT

FIELD OF THE INVENTION

The present invention relates to a lift assembly for aiding wheel-chair patients to get into and out of a van or the like.

DESCRIPTION OF PRIOR ART

A lift assembly of this type comprises a platform laterally supported by an armature and carried from a vertical stored position inside the vehicle to a horizontal position exteriorly of the vehicle level with the vehicle floor and to a ground position.

The user wheels himself onto the platform and actuates means to displace the platform from the vehicle level to the ground or inversely.

This type of known lift assembly (see U.S. Pat. No. 3,651,965 dated May 28, 1972 to Clever Industries) is stored in the vehicle but uses a relatively large percentage of the floor area and, moreover, the platform 4, when in stored position, obstructs the door opening, thus preventing a non-invalid person to use it. Also, the hydraulic systems used to raise or lower the platform are generally bulky and complex.

OBJECTS OF THE INVENTION

It is therefore a first object of the invention to provide a lift assembly mounted in a vehicle and foldable into a compact position within the latter.

Another object of the invention is to provide a lift assembly arranged to leave a passage to a non-invalid person through the door opening when folded within the vehicle.

Another object of the invention is to provide a lift assembly operable by only one power actuator actuating both supporting armatures; such an arrangement reduces the cost and overall dimensions of the assembly.

SUMMARY OF THE INVENTION

In accordance with the invention, the lift assembly is stored in the vehicle just inwardly of the door opening of a vehicle, such as a van or the like.

The lift assembly is arranged to be foldable in a compact position to leave the maximum room inside the vehicle and the platform is rotatable to open a passage through the door opening for a non-invalid person.

The lift assembly comprises a platform which is made of a frame supporting two independent sections displaceable between a coplanar position and a transverse position. The platform is rotatable between an upstanding stored position inside the vehicle and an outside intermediate position level and parallel with the vehicle floor and moveable from that position to the ground and inversely. A pair of armatures, swingable in parallel paths on each side of the platform connect the platform to the vehicle.

DETAILED DESCRIPTION OF THE INVENTION

Figure 1:
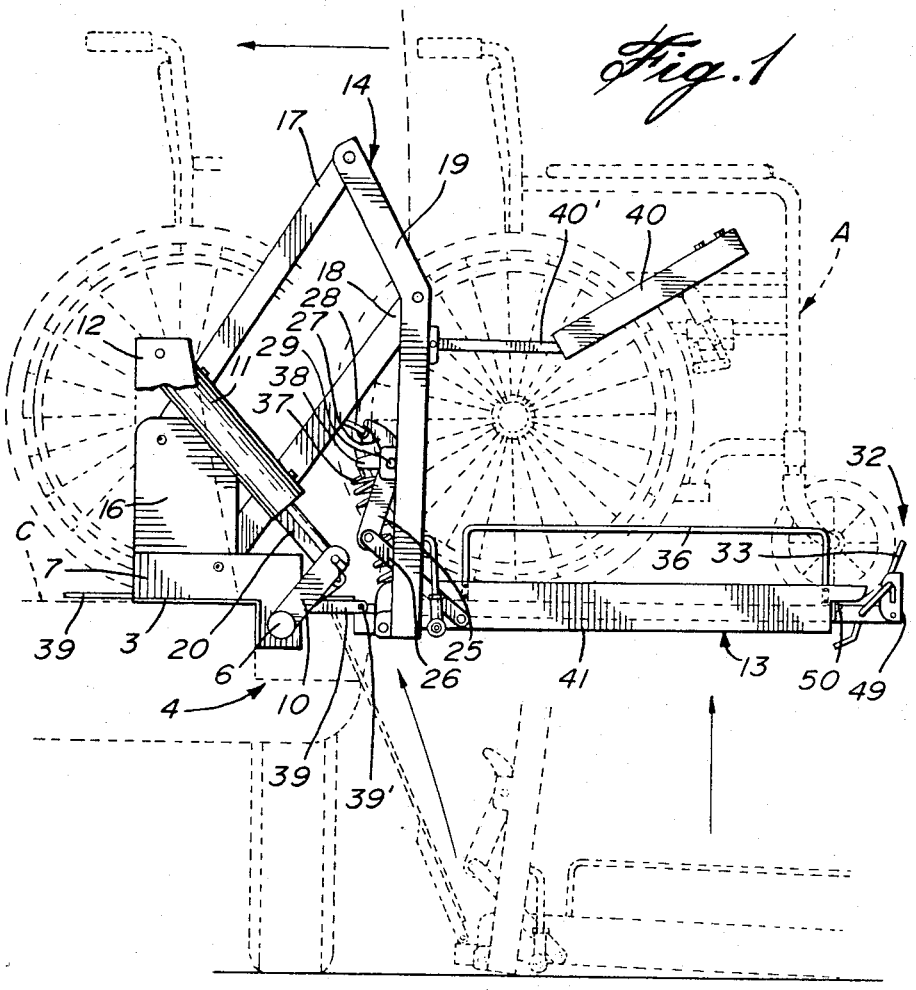
FIG. 1 is a side view showing the lift assembly in an intermediary position with the platform at the level of the vehicle floor.
Figure 2:
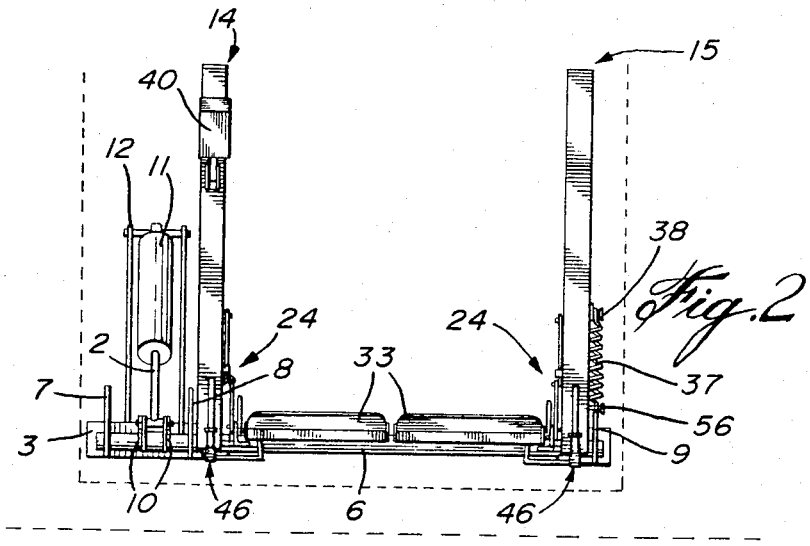
FIG. 2 is a front view of the lift assembly in the same position as in FIG. 1.

With reference to the drawings, the lift assembly is secured at the doorway of a vehicle, such as a van or the like, and comprises an anchoring plate 3 secured to the vehicle floor C and partially engaging in the cavity forming the floor board cavity 4, a transverse shaft 6 having a length comparable to the length of the anchoring plate 3, is rotatably supported in front of the latter alongside the section engaging in the floorboard cavity 4 by means of three brackets 7, 8, 9, (FIGS. 1, 2) respectively positioned at each extremities of the bar 6 and at an intermediate position near the double acting hydraulic cylinder 11 which is connected to the transverse shaft 6 by means of two parallel radial arms 10 secured to shaft 6.

The radial arms 10 are pivotally connected to the hydraulic cylinder piston rod 2 at a first extremity and welded to the transverse shaft 6 at the other extremity.

The hydraulic cylinder 11 is pivotally supported at its upper extremity by two bracket plates 12 upstanding from and secured to anchoring plate 3. In the present embodiment, the hydraulic cylinder 11 is located on the left side of the lift assembly and is used in conjunction with a fluid pump and tank (not shown) which can be installed anywhere in the vehicle.

Figure 5:
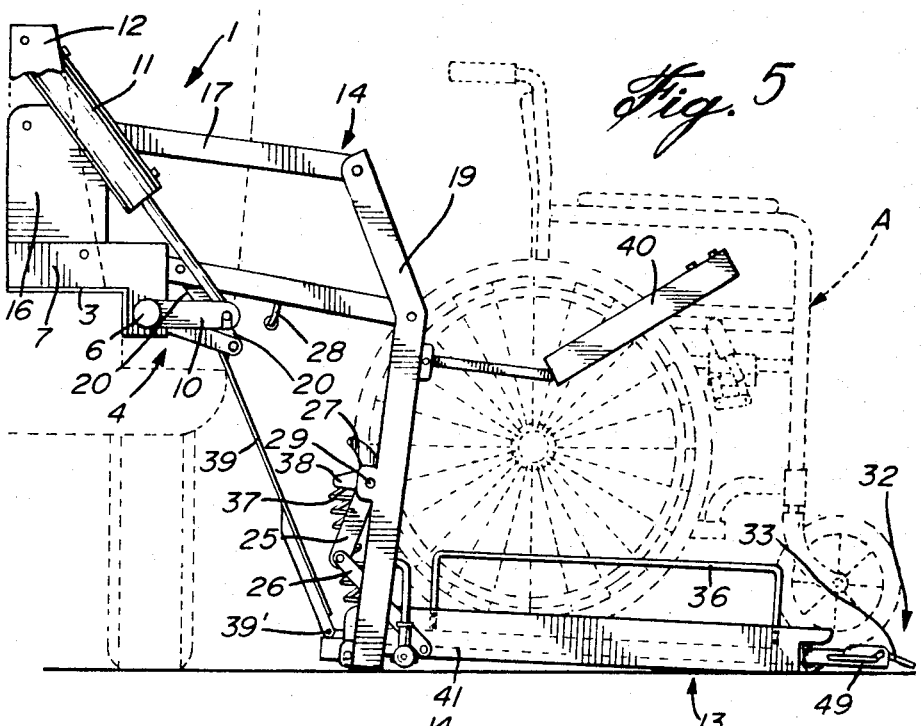
FIG. 5 is a side view of the lift assembly with the platform in ground position.

A platform 13 is pivotally connected to the vehicle 1 by a pair of spaced armatures 14 and 15 which are identical and each pivotally mounted to the anchoring plate 3 through armature brackets 16. Each of said armatures defines with bracket 16 a deformable parallelogram. Each armature is formed of two parallel links 17 and 18 and of a vertical link 19. The parallel links 17 and 18 are pivotally secured at one extremity to the armature bracket 16 and to the vertical link 19 at the other extremity. The lower parallel links 18 on both armatures 14 and 15 are connected to the transverse shaft 6 by means of an articulated linkage 20 (FIGS. 1 and 5) to displace the platform 13 under the action of the hydraulic cylinder 11.

Because of the use of a transverse shaft 6, only one hydraulic cylinder is needed to operate the lift assembly; it is an advantage of the invention to use one cylinder because of the reduction in cost and size of the assembly.

Figure 6:
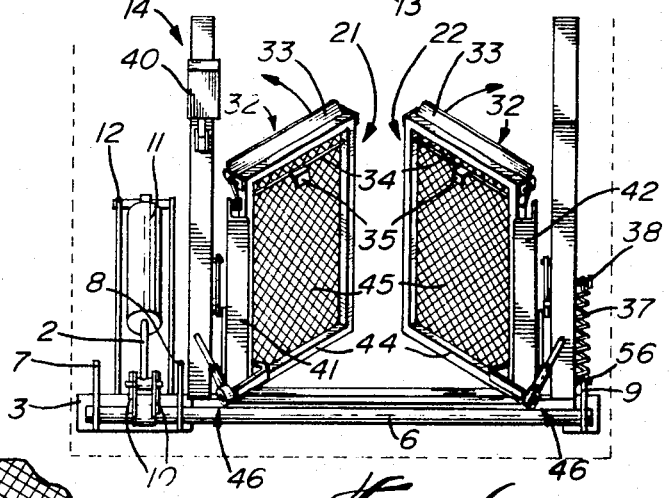
FIG. 6 is a front view of the lift assembly illustrating the rotation of the platform sections just prior to the stored position.

The platform 13 comprises a flat and rigid surface made of two separate sections 21 and 22 (FIGS. 6 and 8) having a combined area sufficient to support a wheel chair A (FIGS. 1, 5) and a frame section 23 supporting the two sections 21 and 22. The frame section 23 comprises a transverse member 43 mounted in rotative relationship by pivot pins 31 in between the lower extremities of the vertical links 19 (FIGS. 7, 8), and two parallel longitudinally extending members 41 and 42 extending transversely from the extremities of the member 43.

Figure 3:
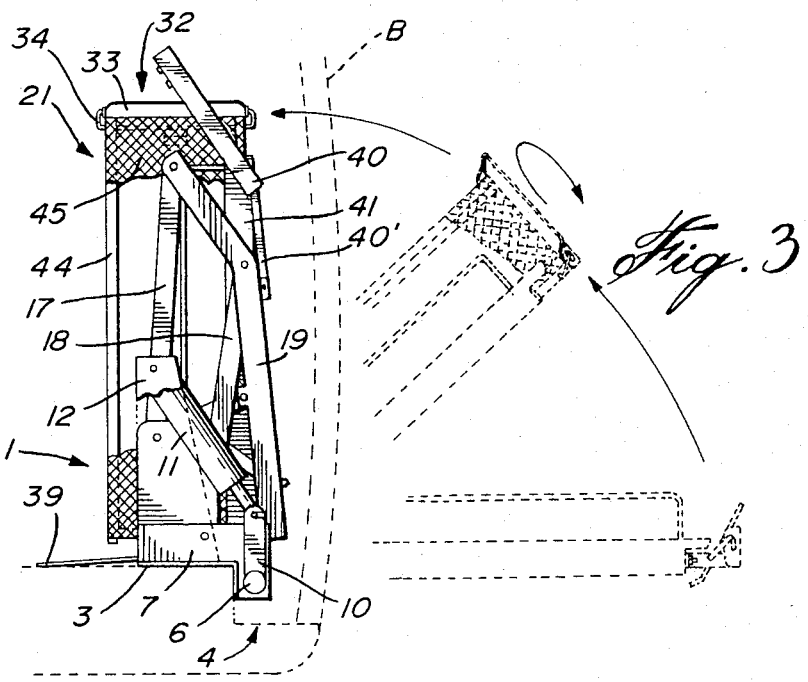
FIG. 3 is a side view of the lift assembly shown in stored position illustrating its compactness.

The platform 13 is normally in a plane parallel to the ground when the lift assembly is in use but for storage it is raised to a vertical position to reduce the storage size and it is shifted within the vehicle 1 to allow closing of the vehicle door B (see FIG. 3). In conventional lifts, the door opening is blocked by the raised platform while in the present invention the platform comprises two sections 21 and 22 separable in the middle to leave a passage through the door for a non-invalid person; it is therefore another advantage of the present invention.

The frame 23 is moveable in between a vertical plane and a horizontal plane by means of a pair of articulated linkages 24 having each two links 25, 26 (see FIGS. 1, 5 and 7) pivotally secured together and installed in between the vertical links 19 and the parallel members 41 and 42 on each side of the lift assembly.

The upper members 25 are ended by a curved section 27. When the platform 13, during its upward movement, has reached its intermediate position level with the vehicle floor C, the curved sections 27 abut on a short rod 28 located on the underside of the lower parallel links 18 causing the rotation of the members 25 around the axis 29 and the displacement of the lower links 26 which pull on the frame sections 23 to pivot the platform 13 upwardly.

The platform sections 21 and 22 are each formed of a rectangular frame 44 which supports a rigid mesh 45. The frames 44 are pivoted to the parallel member 41 or 42 at 50 and to the transverse member 43 at 51 (see FIG. 8).

The frames 44, when coplanar, are also supported by the member 43 by means of a plate 52 secured to each frame 44 and abutting on the top surface of the member 43.

The parallel members 41 and 42 are respectively supported by a pair of tie rods 46 to maintain the platform in a horizontal position.

Figure 7:
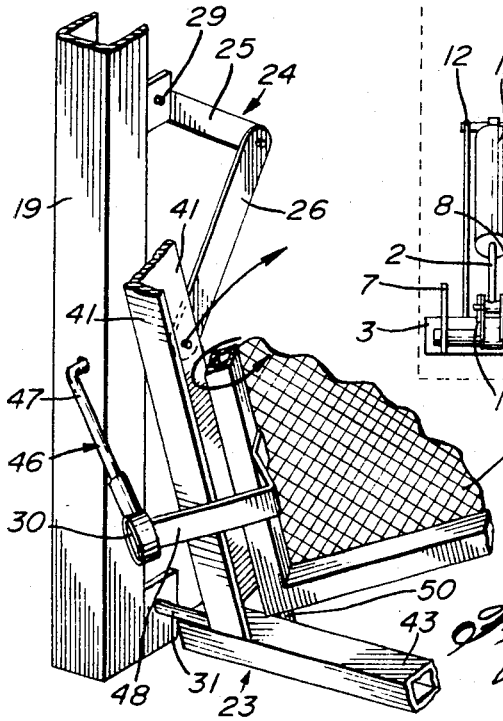
FIG. 7 is a fragmentary perspective view showing the relation between a platform section, its supporting frame and the armature, also the mechanism used to rotate the platform section.
Figure 8:
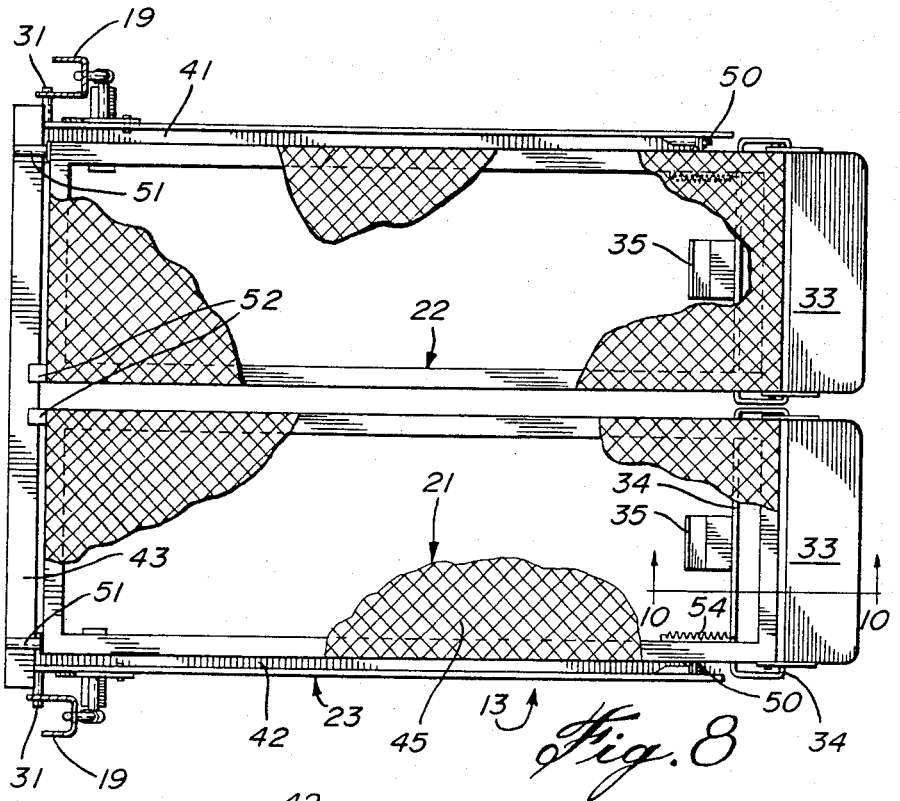
FIG. 8 is a top plan view of the platform assembly.
Figure 9:
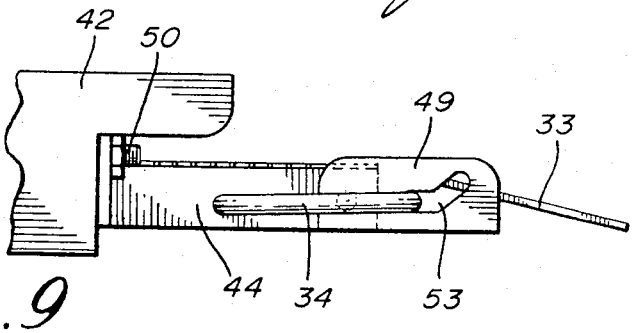
FIG. 9 is a fragmentary side view showing a front guard in its lowered position.

The tie rods 46 are also respectively forcing the platform sections 21 and 22 from a position where they lie in the same plane to a transverse position as seen in FIG. 7. The tie rods 46 each comprise a first rod 47, a second rod 48 and a socket and ball joint 30 securing the first and the second rod together in order to allow an angular movement and a rotation of the second rod 48. The ball and socket joint 30 rotates about the axis of the first rod 47.

The first rod 47 is pivotally connected to the vertical link 19 for movement only in a plane parallel to the plane joining the two vertical links 19 and the second rod 48 is secured to the rectangular frame 44 and extends underneath and is normal to member 41, the tie rods 46 force the platform sections 21 and 22 to a transverse position when the lift assembly is moving for storage and the platform 13 is pivoting to an upstanding position; because the tie rods 46 are not flexible, the platform sections 21 and 22 have to pivot.

It is an advantage of the invention because it will be possible for a non-invalid person to use the door opening when the lift assembly is in its stored position.

Barriers are installed around the platform 13 as a security measure to prevent the user from falling (see FIGS. 1, 5, 8, 9 and 10).

Lateral barriers 36 upwardly extend from and are fixed to the parallel members 41 and 42 and front barriers 32 are pivotally secured to the front edge of the frames 44 and each comprises a protection plate 33, a pair of guiding plates 49 pivotally secured at 49' on either sides of the frame 44 and supporting the plate 33. A rod 34 having its extremities slidably secured in slots 53 of the guide plates 49, forms a loop pivotally supported by the frame 44. A striking plate 35 is fixed to the center of the loop formed by rod 34.

Each protection plate 33 is biased to an upward position by means of a tension spring 54 which is secured at its ends to the frame 44 and to a small pin 55 transversely mounted on the rod 34.

Figure 10:
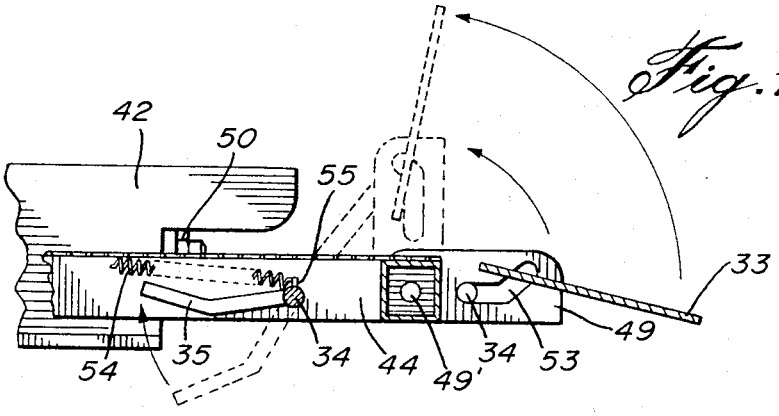
FIG. 10 is a sectional view of a front guard taken on line 10—10 of FIG. 8.

When protection plate 33 is in upward position, striking plate 35 protrudes from the underside of frame 44 as shown in dotted lines in FIG. 10. When the platform 13 is lowered to ground level, striking plate 35 abuts the ground and pivots protection plate 33 to lowered ground engaging position, shown in full lines in FIGS. 9 and 10, to permit passage of the wheel chair A.

A ramp 39 (see FIGS. 1 and 5) is used to bridge the gap between the platform 13 and the vehicle floor C when the platform 13 is horizontal and level with the vehicle floor and is also used as a barrier when the lift assembly is moving from the intermediate position level with the vehicle floor C to the ground or inversely.

The ramp 39 is pivotally secured at 39' to the transverse member 43 and extends inside the vehicle a sufficient distance to allow the platform 13 to be lowered to the ground level with the ramp 39 still resting on the door opening sill or floor board cavity 4 so that it will slide back inside the vehicle when the platform 13 is raised.

When the lift assembly is moved out from its stored position, means are needed to help the frame section 23 rotate from an upstanding position to a horizontal position.

Figure 4:
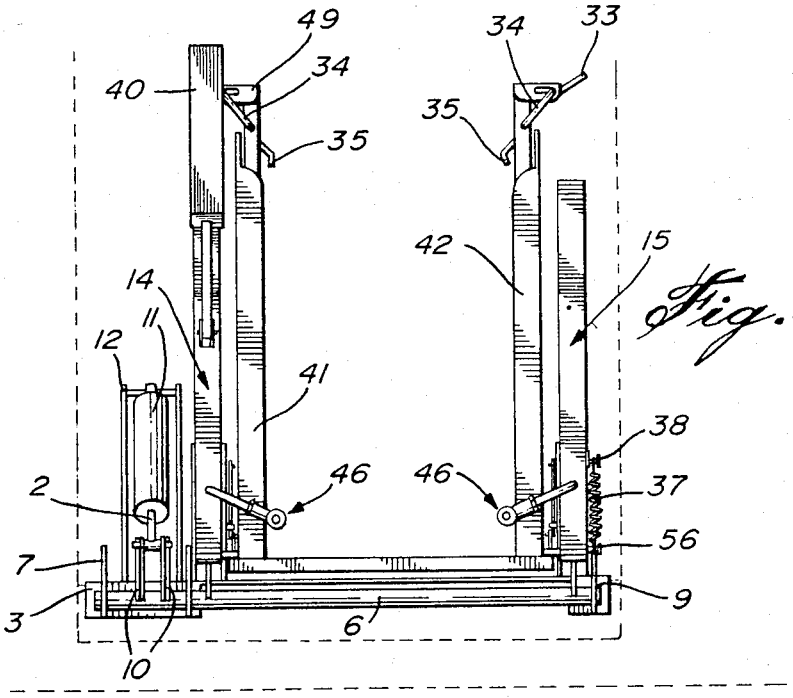
FIG. 4 is a front view showing the lift assembly in a stored position as in FIG. 3.

These means are installed on the armature 15 (see FIGS. 1, 2 and 4) and comprise a tension spring 37 secured at one extremity to a support 38 extending from the curved section 27 of the upper link 25 and at the other extremity to a hook 56 secured to the lower section of the vertical member 19.

The spring 37 forces the articulated linkage 24 to rotate the platform 13 downwardly.

In a preferred embodiment, a control box 40 is secured to an arm 40' (see FIGS. 1 and 3), which is pivotally secured to one of the two vertical links 19 being moveable between operative and stored position. Box 40 carries control buttons electrically connected to an electrical circuit for the control of a hydraulic circuit (not shown), including a hydraulic pump and the hydraulic cylinder 11. Control box 40 permits the user to operate the lift assembly alone.

As shown in FIG. 3, when the lift assembly is in stored position, it completely clears the conventional sliding door B of the vehicle.

What I claim is:

1. A lift assembly for use in association with a vehicle having a door opening and a floor, said assembly comprising an anchoring plate means fixedly secured to said floor inwardly of said door opening and a platform rotatable relative to said anchoring plate means between an upstanding stored position inside the vehicle and an outside intermediate position level and parallel with the vehicle floor at said door opening, and movable from that position to a lower position at ground level and inversely, said platform including a platform frame, and two independent platform sections pivotally secured to said platform frame respectively, said platform sections being rotatable between a position where they lie in the same plane to form a flat surface and a transverse opened position to allow a non-invalid person to use the vehicle door when said platform is in stored position, a pair of armatures, swingable in parallel paths normal to and at each side of said platform, connected to the latter and pivotally connected to said anchoring plate means, said armatures each consisting of a deformable parallelogram system including upper and lower superposed parallel members and a substantially vertical member which is pivotally connected at its upper end to said parallel members and to said platform at its lower end and which extends at a lower level than said superposed members when said platform is at said lower position, bi-directional motor means carried by said anchoring plate means and connected to said armatures to swing the latter and a pair of articulated members rotating said platform between said intermediate position and said upstanding stored position when said armatures are moving toward the interior of the vehicle, said articulated members each comprising an upper link and a lower link secured together in rotative relationship, said upper link being pivotally secured to said vertical member of said armatures and pivoting when abutting with the lower parallel member of said armature, the rotation of said upper link displacing the lower link which is pivotally connected to said platform frame.

2. The lift assembly as set forth in claim 1, wherein a linkage connects said armatures to said motor means, said linkage comprising a shaft extending transversely of said armatures and connected with said motor means to be rotatable in either directions and means to connect said armatures to said shaft.

3. The lift assembly as set forth in claim 2, wherein said motor means include a hydraulic cylinder and piston unit pivotally connected to said anchoring plate means at one end and at its other end to a radial arm secured to said shaft and forming part of said linkage.

4. A lift assembly for use in association with a vehicle having a door opening and a floor, said assembly comprising an anchoring plate means fixedly secured to said vehicle floor inwardly of said door opening and a platform rotatable relative to said anchoring plate means between an upstanding stored position inside the vehicle and an outside intermediate position level and parallel with the vehicle floor at said door opening, and movable from that intermediate position to a lower position at ground level and inversely, said platform including a platform frame, two independent platform sections pivotally secured to said platform frame, said platform sections being rotatable between a position where they lie in the same plane to form a flat surface and a transverse open position to allow a non-invalid person to use the vehicle door when said platform is in a stored position; a pair of armatures, swingable in parallel paths normal to and at each side of said platform connected to the latter and pivotally connected to said anchoring plate means, said armatures each consisting of a deformable parallelogram system including upper and lower superposed parallel members and a substantially vertical member which is pivotally connected at its upper end to said parallel members and to said platform at its lower end and which extends at a lower level than said superposed members when said platform is at said lower position, bi-directional motor means carried by said anchoring plate means and connected to said armatures to swing the latter and a pair of tie-rods respectively forcing said platform sections from a position where they lie in the same plane to said transverse open position when said platform is rotated to said upstanding stored position, said tie-rods each comprise a first rod, a second rod, a pivotal joint securing said first and second rods, said first rod being pivotally connected to the vertical member of said armature and said second rod being secured to said platform section.

5. The lift assembly as set forth in claim 4, wherein a pair of tie rods are respectively forcing said platform sections from a position where they lie in the same plane to a transverse position when said platform is rotated to an upstanding position, said tie rods each comprise a first rod, a second rod, a pivotal joint securing said first and second rods, said first rod being pivotally connected to the vertical member of said armature and said second rod being secured to said platform section.

6. The lift assembly as set forth in claim 5, wherein a ramp extends in between said vehicle and said platform, said ramp being pivotally secured to said platform and arranged to slide on said floor when said platform is displaced.

7. The lift assembly as set forth in claim 6, wherein barriers are carried by said platform sections at the extremity which is remote from the vehicle, each barrier comprising a pivoted protection plate, means to bias said protection plate to an upward position when said platform is not in contact with the ground and means to pivot said protection plate to a substantially horizontal position when said platform contacts the ground.

* * * * *